US005547400A

United States Patent [19]

Wright

[11] Patent Number: 5,547,400

[45] Date of Patent: Aug. 20, 1996

[54] CONNECTOR MODULE

[75] Inventor: John O. Wright, York, Pa.

[73] Assignee: Osram Sylvania Inc., Danvers, Mass.

[21] Appl. No.: 427,476

[22] Filed: Apr. 24, 1995

[51] Int. Cl.[6] ..... H01R 17/04

[52] U.S. Cl. ..... 439/668; 439/63; 439/731; 439/848

[58] Field of Search ..... 439/668, 63, 581, 439/752.5, 731, 675, 848

[56] References Cited

U.S. PATENT DOCUMENTS 4,846,719 7/1989 Iwashita ..... 439/668
5,230,641 7/1993 Wharton ..... 439/668

*Primary Examiner*—Neil Abrams
*Assistant Examiner*—Eugene G. Byrd
*Attorney, Agent, or Firm*—William H. McNeill

[57] ABSTRACT

A connector module is provided which includes a base which houses a metal shell, and a first metal connector such as a female connector, and a cover which encloses the metal shell and female connector relative to the base. The base includes projections which extend into apertures in a second metal connector such as a male connector, which has been mated with the female connector, to prevent inadvertent rotational movement between the male and female connectors. The metal shell includes protrusions which mate with protuberances of the male connector to prevent inadvertent axial movement between the male and female connectors.

20 Claims, 2 Drawing Sheets

CONNECTOR MODULE

BACKGROUND OF THE INVENTION

1. Field of the Invention

The present invention relates to a connector such as, for example, an antenna connector. More particularly, the present invention relates to a connector module for use with an antenna connector.

2. Description of the Prior Art

A typical antenna connector for an antenna cable such as those used in the automobile industry for radios includes a male connector body generally in the form of a plug and a female connector body generally in the form of a ferrule which forms a socket. In use, the male connector body is plugged into the female connector body to effect a mechanical and electrical connection between the two. Typically, an antenna cable in the form of a coaxial cable is electrically and mechanically attached to one of the connectors such as the male connector, and the other connector, such as the female connector, is electrically and mechanically attached to a circuit such as a circuit on a printed circuit board. In such prior art devices inadvertent axial and/or rotational movement of the male connector body relative to the female connector body makes providing a satisfactory electrical connection difficult. In addition, the lack of satisfactory tactile feedback makes it difficult to know when a suitable connection has been made.

DISCLOSURE OF THE INVENTION

It is an object of the present invention to provide an antenna connector wherein the male connector body does not inadvertently move in a rotational and/or an axial direction relative to the female connector body.

It is another object of the present invention to provide such an antenna connector which provides tactile feedback during assembly.

This invention achieves these and other objects, in one aspect of the invention, by providing a connector module comprising a base having a first surface, and an opposite second surface. A first channel extends into the base from the first surface towards the second surface. The first channel also extends in the direction of a longitudinal axis of the base from a first end of the base towards an opposite second end of the base. A second channel extends into the base from the first surface towards the second surface. The second channel also extends in the direction of the longitudinal axis from the opposite second end towards the first end. The second channel opens into the first channel. A cover is removably attachable to the base to enclose the first channel and the second channel in a closed mode and to expose the first channel and the second channel in an open mode. A metal shell is positioned within the first channel and extends in the direction of the longitudinal axis. A metal connector is positioned within the second channel and extends in the direction of the longitudinal axis.

BRIEF DESCRIPTION OF THE DRAWINGS

This invention may be clearly understood by reference to the attached drawings in which.

BEST MODE FOR CARRYING OUT THE INVENTION

For a better understanding of the present invention, together with other and further objects, advantages and capabilities thereof, reference is made to the following disclosure and appended claims taken in conjunction with the abovedescribed drawings.

Figure 1:
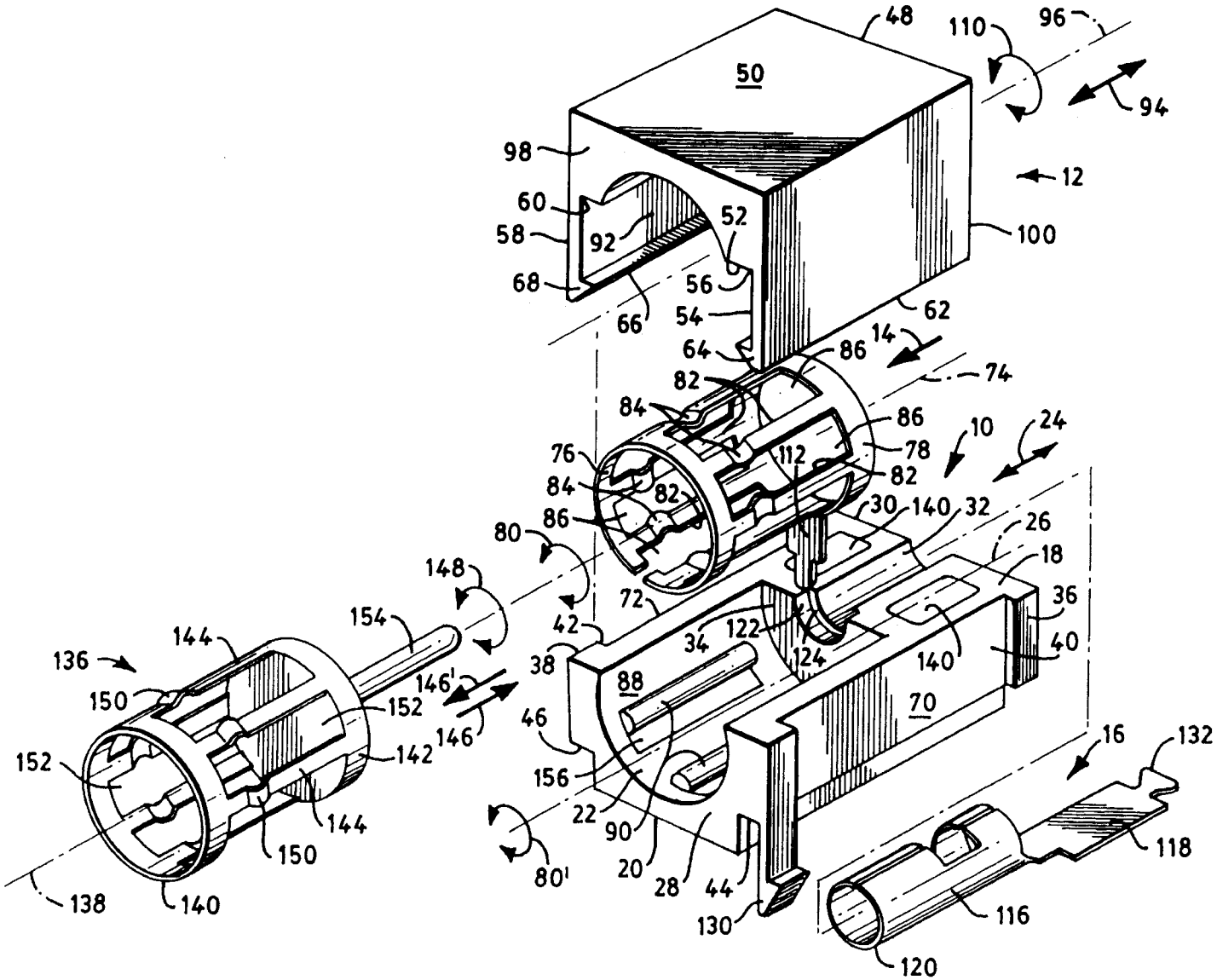
FIG. 1 is an exploded perspective view of a connector module embodying the present invention.
Figure 2:
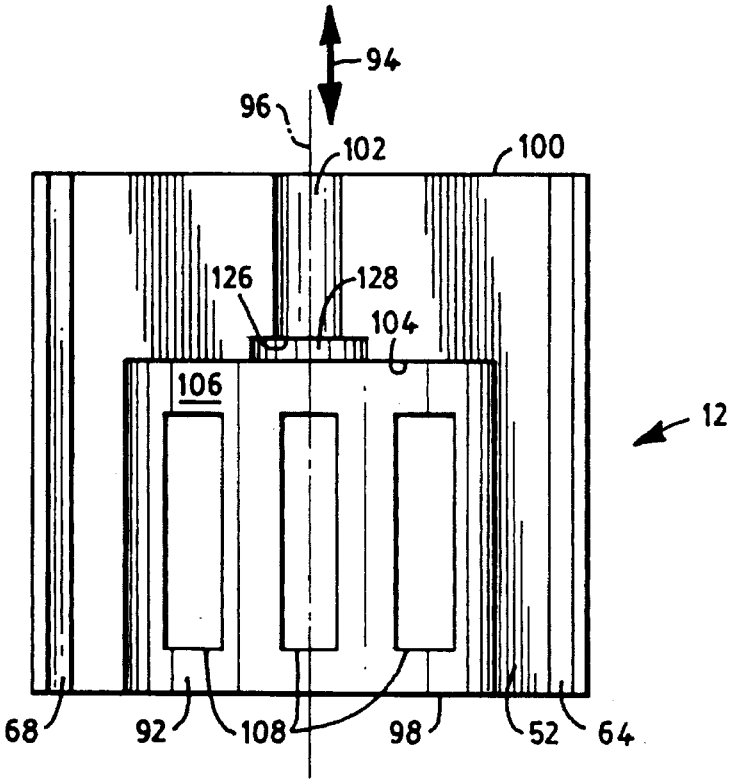
FIG. 2 is a bottom view of a cover for the connector module of FIG. 1.
Figure 3:
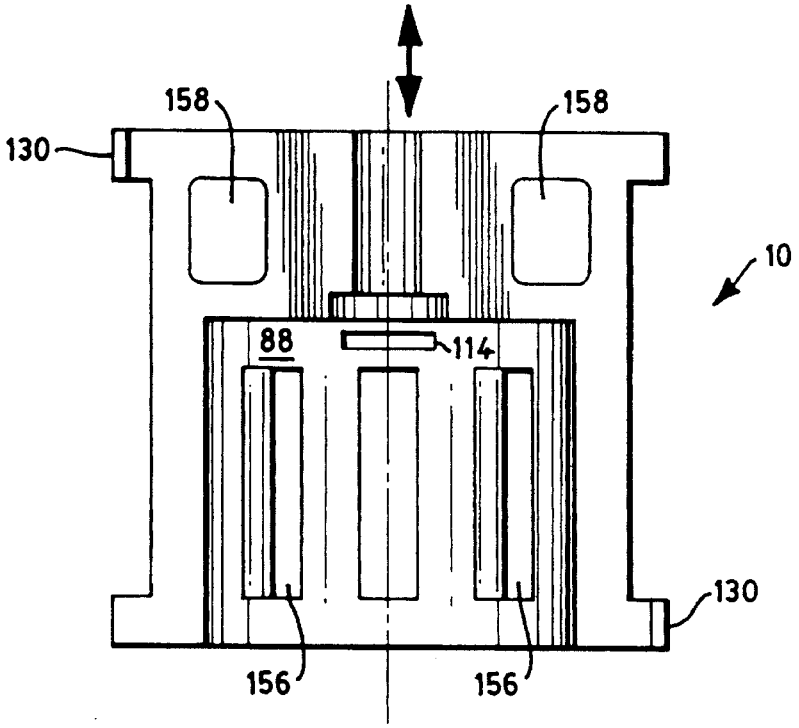
FIG. 3 is a plan view of the base of the connector module of FIG. 1.

The embodiment of this invention which is illustrated in FIGS. 1 to 3 is particularly suited for achieving the objects of this invention. FIG. 1 depicts a connector module which comprises a housing in which a metal connector shell and a metal connector may be secured. The housing includes a base 10 and a cover 12 in which a metal connector shell 14 and a metal connector 16 may be secured as described herein.

In viewing FIG. 1, the base includes an upper surface 18 and a lower surface 20. A channel 22 extends into the base 10 from surface 18 towards surface 20. Channel 22 extends in the direction 24 of a longitudinal axis 26 of the base 10 from an end 28 of the base towards and opposite end 30 of the base. Another channel 32 extends into the base 10 from surface 18 towards surface 20. Channel 32 extends in the direction 24 of longitudinal axis 26 from end 30 towards end 28. Channel 32 opens into channel 22 at interface 34.

Cover 12 is removably attachable to base 10 to enclose channel 22 and channel 32 in a closed mode and to expose channel 22 and channel 32 in an open mode. To this end, base 10 includes a side 36 and an opposite side 38 each of which extend from end 28 to end 30. Side 36 comprises a groove 40 and opposite side 38 comprises an opposite groove 42. Grooves 40 and 42 extend from surface 18 to surfaces 44 and 46, respectively. The cover 12 comprises a top 48 having an outer surface 50 and an inner surface 52. A resilient leg 54 extends away from the inner surface 52 at one edge 56 of the inner surface, and a resilient leg 58 extends away from the inner surface 52 at another edge 60 of the inner surface. The width of grooves 40 and 42 are dimensioned relative to the width of legs 54 and 58, respectively, such that leg 54 mates with groove 40 and leg 58 mates with groove 42 in a closed mode. A distal end 62 of leg 54 includes a flanged snap member 64, and a distal end 66 of leg 58 includes an opposite flanged snap member 68. The height of legs 54 and 58 relative to the height of grooves 40 and 42, respectively, and the distance between snap members 64 and 68 relative to the distance between the base 70 of groove 40 and the base 72 of groove 42, respectively, are dimensioned such that flanged snap members 64 and 68 will snap into engagement with respective surfaces 44 and 46 in the closed mode to lock the cover 12 to the base 10.

The metal connector shell 14 is configured to be positioned within the channel 22 of the base 10 so that the shell extends in the direction 24 of axis 26. In the embodiment of FIGS. 1 to 3 shell 14 comprises a cylindrical member having a lengthwise axis 74. A section 76 of the cylindrical member and an opposite section 78 extend in a circumferential direction 80 relative to axis 74. A plurality of resilient bridging members 82 extend from section 76 to opposite section 78, each bridging member having a protrusion 84 which protrudes towards axis 74. Adjacent bridging members border openings 86 therebetween.

In the embodiment of FIGS. 1 to 3 the channel 22 comprises a channel surface which includes at least one protuberance which protrudes towards axis 26. Channel 22 comprises a channel surface 88 which includes a plurality of elongated projections 90 which project toward axis 26. Projections 90 extend in the direction 24 of axis 26. Adjacent elongated projections 90 are spaced apart from each other in circumferential direction 80'. At least one elongated projection 90 will extend through an opening 86 when the shell 14 is positioned within channel 22. In the embodiment of FIGS. 1 to 3, each projection 90 will extend into a respective opening 86.

In the embodiment depicted in FIGS. 1 to 3, a channel 92 is formed in the cover 12. Channel 92 extends into cover 12 from the inner surface 52 towards the outer surface 50. Channel 92 extends in the direction 94 of a longitudinal axis 96 of the cover from an and 98 of the cover towards and opposite end 100. Similarly, a channel 102 extends into cover 12 from the inner surface 52 towards the outer surface 50. Channel 102 extends in the direction 94 of axis 96 from end 100 towards end 98. Channel 102 opens into channel 92 at interface 104.

In the preferred embodiment, channel 92 comprises a channel surface which includes at least one protuberance which protrudes towards axis 96. In the embodiment of FIGS. 1 to 3, channel 92 comprises a channel surface 106 which includes a plurality of elongated projections 108 which project towards axis 96. Projections 108 extend in the direction 94 of axis 96. Adjacent elongated projections 108 are spaced apart from each other in a circumferential direction 110 relative to axis 96. Each elongated projection 108 will extend through a respective opening 86 of shell 14 when the connector module of the present invention is assembled as described herein.

The metal shell of the present invention comprises a tab which extends into an opening formed in the base to prevent movement of the metal shell relative to the base. In the embodiment of FIGS. 1 to 3, the metal shell 14 comprises a tab 112 which mates with and extends through a slot 114 which extends through the base 10 from surface 88 to surface 20. A conductor (not shown) may be electrically and mechanically connected to the tab 112 where it extends outside of the base 10 at slot 114. For example, the tab 112 may be electrically connected to a circuit of a printed circuit board.

The metal connector 16 is configured to be positioned within the channel 32 of base 10 so that the connector extends in the direction of axis 26. Connector 16 may be a conventional female ferrule, as depicted in FIG. 1, which includes a female receptacle 116 into which a male connector may be inserted in the usual manner and a tab 118 to which a conductor may be electrically and mechanically connected as, for example, by soldering. Alternatively, the connector 116 may be a conventional male connector to which a conventional female ferrule may be connected. In the embodiment of FIGS. 1 to 3, the end 120 of ferrule 16 is flanged or flared. By fabricating a base 10 having a channel 32 which includes a countersunk portion 122 forming a surface 124, ferrule 16 may be properly positioned within channel 32 by causing the flanged or flared end 120 to bear against surface 124. A similar surface 126 formed by a countersunk portion 128 of channel 102 is formed in the cover 12.

Use of the connector module will now be described with reference to FIG. 1. The metal connector shell 14 is placed within the cavity 22 such that the tab 112 extends into and through slot 114. The elongated projections 90 are spaced relative to the lower three openings 86 so that when the shell 14 is placed within cavity 22, each elongated projection 90 will extend through a respective one of the lower three openings 86. The metal connector ferrule 16 is placed within the cavity 32 such that the flanged or flared end 120 bears against surface 124 and the distal end 130 of tab 118 extends in the direction 24 of axis 26 away from end 30 of base 10. The cover 12 is then attached to the base 10 by engaging the bases 70 and 72 of respective grooves 40 and 42 with respective snap members 64 and 68 which are spread slightly apart against the resiliency of legs 54 and 58. The cover is then pushed downward causing the snap members 64 and 68 to slide upon respective bases 70 and 72 until the snap members snap into place against respective surfaces 44 and 46. The connector module is now ready for insertion of a male connector.

It should be noted that the elongated projections 108 of cover 12 are spaced relative to the upper three openings 86 such that when the cover 12 has been attached to the base 10, a portion of the shell 14 will be located within cavity 92 such that each projection 108 will extend through a respective one of the upper three openings 86. In addition, when the cover 12 has been affixed to the base 10 the ferrule 16 will be located within cavity 102 such that the flanged or flared end 120 will bear against surface 126 and the distal end 130 of tab 118 will extend in the direction of axis 26 away from end 100. If desired, the connector may be fastened to a supporting surface by providing, for example, snap members 132 which extend from diagonally opposite comers of the base 10.

When the connector has been assembled in this manner, the channels 22 and 92, which extend in respective circumferential directions 80' and 110, form a cylindrical opening having a diameter which is substantially equal to the diameter of the metal connector shell 14. Similarly, the channels 32 and 102, which also extend in respective circumferential directions 80' and 110, form a cylindrical opening having a diameter which is substantially equal to the diameter of the metal connector ferrule 16. In the embodiment of FIGS. 1 to 3, the diameter of the shell 14 is greater than the diameter of the ferrule 16.

A metal connector 136 in the form of a male plug is provided which is removably attachable to the female connector or ferrule 16. It will be apparent to those skilled in the art that if desired connector 136 may be in the form of a female connector in which case connector 16 will be in the form of a male connector. Which ever form of connector is used, the metal connector 136 will generally have a shape similar to a truncated cone which tapers towards a horizontal axis 138 of the metal connector 136 from a segment 140 to an opposite segment 142. A plurality of resilient ribs 144 extend in the direction 146, 146' of axis 138 from segment 140 to segment 142. The ribs 144 are spaced from each other in a circumferential direction 148 relative to axis 138 and are arched such that each rib 144 comprises a protuberance 150 which protrudes away from axis 138. Adjacent ribs 144 border an aperture 152 therebetween. Metal connector 136 also comprises a prong 154 which extends in the direction of axis 138.

When the male connector 136 is plugged into the female connector 16, the prong 154 will enter the female receptacle 116 in the usual manner. The truncated cone segment of the male connector will penetrate the metal connector shell 14. To this end, as the truncated cone segment enters into the shell 14, each pro-tuberance 150 will engage a respective protrusion 84. Due to the resiliency of the bridging members 82 and/or the resiliency of the ribs 144 the protuber-ances 150 and the protrusions 84 will deflect relative to each other until protuberances 150 snap to a position which in FIG. 1 will be immediately to the right of protrusions 84 such that each protuberance 150 will engage and lockingly bear against with a respective protrusion 84 to thereby prevent the male connector 136 from inadvertently moving in an axial direction 146' relative to the female connector 16. The deflection of the protuberances 150 relative to the protrusions 84 provides tactile feedback to the assembler assuring the assembler that a satisfactory connection has been made.

Fabrication of the various components described herein may be accomplished using conventional procedures. For example, base 10 and cover 12 may be molded from a plastic material. Shell 14, ferrule 16 and male connector 136 may be stamped from a metal sheet and then rolled and bent to form the desired configuration. If desired openings 156 and 158 may be provided in the base 12.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A connector module comprising:

a base having a first surface, an opposite second surface, a first channel extending into said base from said first surface towards said opposite second surface, said first channel further extending in the direction of a longitudinal axis of said base from a first end of said base towards an opposite second end of said base, and a second channel extending into said base from said first surface towards said second surface, said second channel further extending in the direction of said longitudinal axis of said base from said opposite second end of said base towards said first end of said base, said second channel opening into said first channel;

a cover removably attachable to said base to enclose said first channel and said second channel in a closed mode and to expose said first channel and said second channel in an open mode;

a metal shell positioned within said first channel and extending in the direction of said longitudinal axis of said base; and a first metal connector positioned within said second channel and extending in the direction of said longitudinal axis of said base.

2. The connector module of claim 1 wherein said first channel comprises a first channel surface, and further includes a hole which extends into said first channel surface, said metal shell comprising a tab which extends into said hole.

3. The connector module of claim 2 wherein said hole is a slot which extends through said base and said tab mates with and extends through said slot.

4. The connector module of claim 1 wherein said metal shell comprises a first section and an opposite second section spaced from said first section in the direction of a lengthwise axis of said metal shell, and a plurality of bridging members which extend in the direction of said lengthwise axis from said first section to said opposite second section, each bridging member of said plurality of bridging members having a protrusion which protrudes towards said lengthwise axis.

5. The connector module of claim 1 wherein said first channel comprises a channel surface, and further wherein said channel surface comprises a plurality of elongated projections which project towards, and extend in the direction of said longitudinal axis of said base, adjacent elongated projections of said plurality of elongated projections being spaced from each other in a circumferential direction relative to said longitudinal axis of said base of said cover.

6. The connector module of claim 5 wherein said metal shell comprises a first section and an opposite second section spaced from said first section in the direction of a lengthwise axis of said metal shell, and a plurality of bridging members which extend in the direction of said lengthwise axis from said first section to said second section, each bridging member of said plurality of bridging members having a protrusion which protrudes towards said lengthwise axis, adjacent bridging members of said plurality of bridging members bordering an opening therebetween, an elongated projection of said plurality of elongated projections extending through a respective opening.

7. The connector module of claim 1 wherein said cover comprises a top having an outer surface and an inner surface, a third channel extending into said cover from said inner surface towards said outer surface, said third channel further extending in the direction of a longitudinal axis of said cover from a first end of said cover towards an opposite second end of said cover, and a fourth channel extending into said cover from said inner surface towards said outer surface, said fourth channel further extending in the direction of said longitudinal axis of said cover from said opposite second end of said cover towards said first end of said cover, said fourth channel opening into said third channel, said third channel being adjacent said first channel to form a first opening, and said fourth channel being adjacent said second channel to form a second opening, in said closed mode.

8. The connector module of claim 7 wherein a first diameter of said first opening is substantially equal to a diameter of said metal shell, and further wherein a second diameter of said second opening is substantially equal to a diameter of said first metal connector.

9. The connector module of claim 8 wherein said first diameter is greater than said second diameter.

10. The connector module of claim 7 wherein said third channel comprises a first channel surface, said first channel surface comprising a plurality of elongated protuberances which protrude towards and extend in the direction of said longitudinal axis of said cover, elongated adjacent protuberances of said plurality of elongated protuberances being spaced from each other in a circumferential direction relative to said longitudinal axis of said cover.

11. The connector module of claim 10 wherein said metal shell comprises a first section and an opposite second section spaced from said first section in the direction of a lengthwise axis of said metal shell, and a plurality of bridging members which extend in the direction of said lengthwise axis from said first section to said opposite second section, each bridging member of said plurality of bridging members having a protrusion which protrudes towards said lengthwise axis, adjacent bridging members of said plurality of bridging members bordering an opening therebetween, an elongated protuberance of said plurality of elongated protuberances extending through a respective opening.

12. The connector module of claim 11 wherein said first channel comprises a second channel surface, and further wherein said second channel surface comprises a plurality of elongated projections which project towards, and extend in the direction of, said longitudinal axis of said base, adjacent elongated projections of said plurality of elongated projections being spaced from each other in a circumferential direction relative to said longitudinal axis of said base, an elongated projection of said plurality of elongated projections extending through a respective opening.

13. The connector module of claim 12, further including a hole which extends into said second channel surface, and further wherein said opposite second section comprises a tab, said tab extending into said hole.

14. The connector module of claim 13 wherein said hole is a slot which extends through said base and said tab mates with and extends through said slot.

15. The connector module of claim 6 further comprising a second metal connector removably attachable to said first metal connector, said second metal connector comprising a first segment and an opposite second segment spaced from said first segment in the direction of a horizontal axis of said second metal connector, a plurality of ribs which extend in the direction of said horizontal axis from said first segment to said opposite second segment, each rib of said plurality of ribs having a protuberance which protrudes away from said horizontal axis, adjacent ribs of said plurality of ribs bordering an aperture therebetween, each protuberance being adjacent to and lockingly mating with a protrusion, and an elongated projection of said plurality of elongated projections extending into a respective aperture, in an engaged mode.

16. The connector module of claim 15 wherein said first channel comprises a first channel surface, and further includes a hole which extends into said first channel surface, said metal shell comprising a tab which extends into said hole.

17. The connector module of claim 12 further comprising a second metal connector removably attachable to said first metal connector, said second metal connector comprising a first segment and an opposite second segment spaced from said first segment in the direction of a horizontal axis of said second metal connector, a plurality of ribs which extend in the direction of said horizontal axis from said first segment to said opposite second segment, each rib of said plurality of ribs having a protuberance which protrudes away from said horizontal axis, adjacent ribs of said plurality of ribs bordering an aperture therebetween, each protuberance being adjacent to and lockingly mating with a protrusion, and an elongated projection of said plurality of elongated projections extending into a respective aperture, in an engaged mode.

18. The connector module of claim 17 wherein said first channel comprises a first channel surface, and further includes a hole which extends into said first channel surface, said metal shell comprising a tab which extends into said hole.

19. A connector module, comprising:

a base having an axis;

a first surface extending into said base to form a first groove which extends in the direction of said axis;

a second surface extending into said base to form a second groove which extends in the direction of said axis, said second groove opening into said first groove;

a cover removably attachable to said base;

a metal connector shell disposed in said first groove and extending in the direction of said axis; and a first metal connector disposed in said second groove and extending in the direction of said axis.

20. The connector module of claim 19 further comprising a second metal connector removably attachable to said first metal connector.

* * * * *